US006647753B2

(12) United States Patent
Engler

(10) Patent No.: US 6,647,753 B2
(45) Date of Patent: Nov. 18, 2003

(54) LOCK WITH AN ELECTROMECHANICAL COUPLING DEVICE

(75) Inventor: Wolfgang Engler, Herbolzheim (DE)

(73) Assignee: Sphinx Elektronik GmbH, Waldkirch (DE)

( * ) Notice: Subject to any disclaimer, the term of this patent is extended or adjusted under 35 U.S.C. 154(b) by 129 days.

(21) Appl. No.: 09/739,200

(22) Filed: Dec. 18, 2000

(65) Prior Publication Data

US 2001/0003913 A1 Jun. 21, 2001

(30) Foreign Application Priority Data

Dec. 16, 1999 (DE) ..... 199 60 791

(51) Int. Cl.[7] ..... E05B 55/04

(52) U.S. Cl. ..... 70/472; 70/277; 70/278.7; 70/386; 70/467; 70/468; 70/472; 70/473

(58) Field of Search ..... 70/277, 278.1, 70/278.7, 283, 386, 467, 468, 472, 473, 477, 483, 150, 151 R; 292/359

(56) References Cited

U.S. PATENT DOCUMENTS 4,148,092 A * 4/1979 Martin ..... 361/172
5,014,030 A * 5/1991 Aston ..... 335/228
5,475,996 A * 12/1995 Chen ..... 70/279.1
5,640,863 A * 6/1997 Frolov ..... 70/283
5,678,868 A * 10/1997 Williams et al. ..... 292/144
5,953,942 A * 9/1999 Doucet et al. ..... 70/283
6,053,019 A * 4/2000 Wiik et al. ..... 70/283
6,094,953 A * 8/2000 Evans ..... 70/278.1
6,145,353 A * 11/2000 Doucet ..... 70/277
6,286,347 B1 * 9/2001 Frolov ..... 70/472
6,363,762 B1 * 4/2002 Kueng ..... 70/278.3

FOREIGN PATENT DOCUMENTS

DE 195 02 288 A1 8/1996
GB 2 211 239 A 6/1989

* cited by examiner

*Primary Examiner*—Anthony Knight
*Assistant Examiner*—John B Walsh
(74) *Attorney, Agent, or Firm*—Henry M. Feiereisen; Ursula B. Day

(57) ABSTRACT

A lock with an electromechanical coupling device, which only consumes little electrical power, comprises an operating handle which constantly is in operative connection with a drive member of an electromechanical coupling device and upon recognition of an authentication code makes an operative connection with a driven member, which in turn is in constant operative connection with the operating mechanism of the lock. The drive member and the driven member of the coupling device are each spring-loaded into a rest position and can be coupled via a locking mechanism, which by means of an electromechanical transducer can be switched between a disengaged position and an engaged position.

17 Claims, 8 Drawing Sheets

FIG. 3
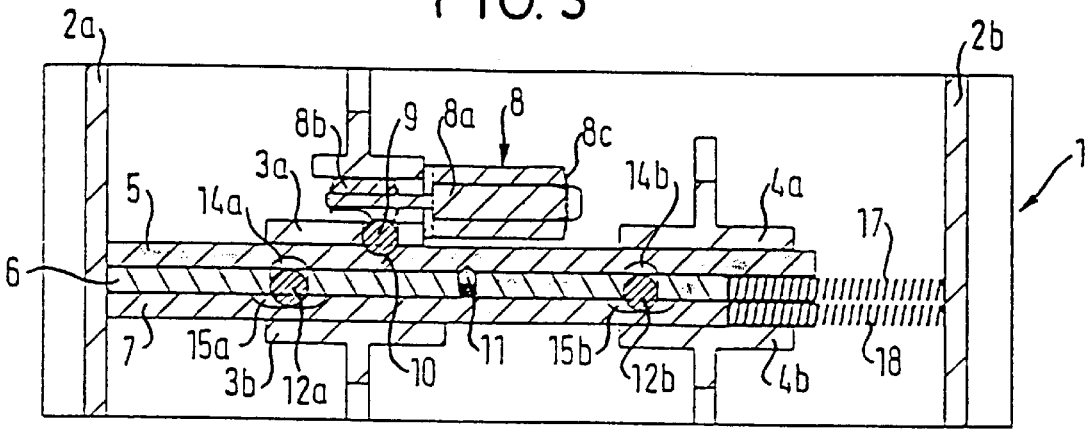
FIG. 4
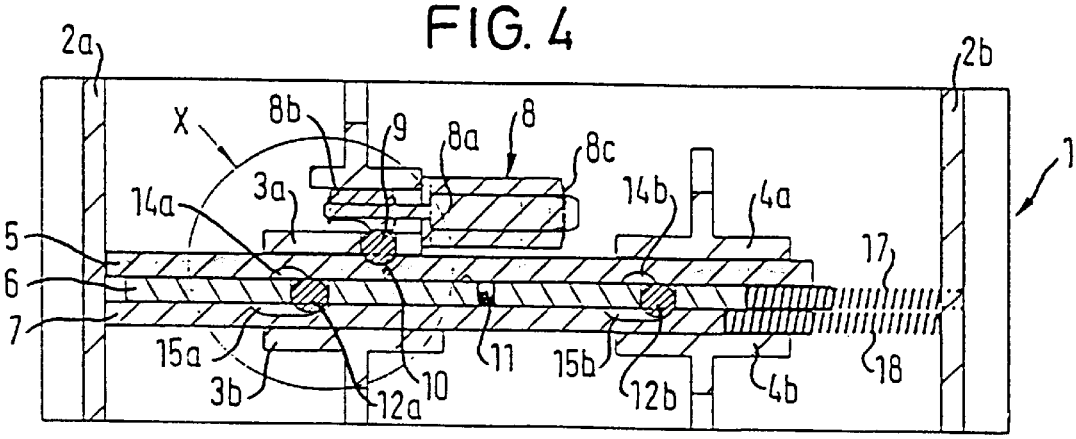
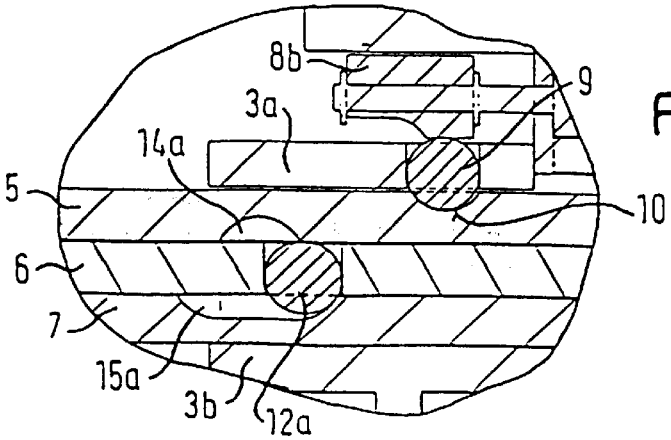
FIG. 4a

LOCK WITH AN ELECTROMECHANICAL COUPLING DEVICE

CROSS-REFERENCES TO RELATED APPLICATIONS

This application claims the priority of German Patent Application Serial No. 199 60 791.5, filed Dec. 16, 1999, the subject matter of which is incorporated herein by reference.

BACKGROUND OF THE INVENTION

The present invention relates to a lock, in particular a door lock, whose operating handle constantly is in operative connection with a drive member of an electromechanical coupling device, which upon recognition of an authentication code makes an operative connection with a driven member, which in turn constantly is in operative connection with the actuating mechanism of the lock. A lock with an electromechanical coupling device is known from British Pat. No. GB 2,211,239 A. The electromechanical coupling device includes an electromagnet, which is at least partly accommodated in the operating handle. As such locks sometimes must take up considerable operating forces without being damaged, the electromechanical coupling device of the known lock has a correspondingly massive design. It therefore requires much space and a powerful supply voltage source, which excludes a battery operation and thus a retrofittability of the lock without complex laying of supply voltage lines.

A lock of the type described above is known from German pat. No. DE 195 02 288 A1. The drive member and the driven member are disposed collinearly and are designed for rotary actuation. The end faces of drive member and driven member facing each other are designed to produce a complementary positive connection when the driven member is moved from the disengaged into the engaged position. To produce the engaged position, the electro-mechanical transducer, which can be a bistable lifting magnet, must move the driven member and, when the positively connected elements are not aligned, also the drive member against the action of the springs loading these parts into their rest position, by overcoming all frictional forces acting on the force-transmitting members. The transducer therefore has a large size and, like the lock in accordance with the prior art described above, requires a powerful supply voltage source which excludes, for instance, a battery operation.

SUMMARY OF THE INVENTION

It is thus an object of the present invention to provide an improved lock, obviating the afore-stated drawbacks.

In particular, it is an object of the present invention to provide an improved lock of the type described above, which requires little volume without a loss in mechanical ruggedness, and which includes an electromechanical coupling device that requires only little electrical power for switching between the disengaged and the engaged position.

These objects, and others which will become apparent hereinafter, are attained in accordance with the present invention by providing a locking mechanism which includes an actuator, which in the disengaged position of the locking mechanism is releasably latched with the drive member and can be moved in the same direction as the drive member, and in the engaged position is blocked in its rest position by means of the electromechanical transducer, with the latching being automatically released upon movement of the drive member, and at least one locking body which is movable in the drive member approximately at right angles to its plane of movement, wherein the actuator has a recess disposed opposite the locking body in the rest position of the parts, and the driven member has a recess which is disposed opposite the locking body, so that in the disengaged position, the driven member in its rest position urges the locking body into the recess of the actuator entrained by the drive member upon movement of the drive member, and in the engaged position, the actuator blocked in its rest position urges the locking body into the recess of the driven member and thereby entrains the driven member, upon movement of the drive member.

To produce the engaged condition, the electromechanical transducer only needs to block the drive member in its rest position, which in any case is spring-loaded in the direction of this rest position. The force required to produce a frictional connection between the drive member and the driven member is produced by the subsequent movement of the drive member itself, i.e. of the user moving the same. Therefore the force-transmitting parts, i.e. primarily the at least one locking body, can be designed according to the maximum force to be expediently transmitted, without the energy demand or the electrical power required by the electromechanical transducer becoming correspondingly high.

Suitably, the releasable latching between the actuator and the drive member includes an engagement part connected with one of the actuator and drive member and engaging in the recess of the other one of actuator and drive member under an elastic bias.

Also contributing to a small demand of electrical energy when the electromechanical transducer in the engaged position brings a locking member into positive engagement with the actuator, in order to block the actuator in its rest position.

An activation of the electromechanical transducer to produce the disengaged position becomes superfluous when in the disengaged position the actuator urges the locking member into the release position when the actuator is entrained by the drive member.

Suitably, the locking body and/or the locking member is a roller or a ball. In the embodiment as roller, greater forces can, of course, be transmitted than in the embodiment as ball. In practice, a plurality of rollers or balls will be used for transmitting the forces, also to avoid jamming of the parts movable with respect to each other.

For simple locks, e.g. wardrobe locks, whose latch or locking bar is actuated without key via a sliding knob, the actuator, the drive member and the driven member can be disposed so as to be linearly movable. The drive member can then be integral with the operating knob, and the driven member can be integral with the latch or the locking bar.

To achieve a compact design, the electromechanical transducer can lie in a plane parallel to the plane of movement of the actuator.

In particular in the embodiment where the door lock has a pawl, the actuator, the drive member and the driven member can be rotatably mounted. This allows the use of a common lock case, which in particular in the case of retrofitting or conversion of existing door locks to a keyless operation, e.g. by means of a code card or a transponder, is of great advantage.

According to another feature of the present invention, the actuator, the drive member and the driven member may be formed by rings with a common axis of rotation. In this case, the ring-shaped drive member is suitably positively connected with a first square for mounting the operating handle, and the ring-shaped driven member is frictionally connected with a second square for actuating the nut of a common door.

To achieve a small building depth, the ring-shaped driven member, the ring-shaped drive member and the ring-shaped actuator can substantially be arranged concentric with respect to each other, with their confronting peripheral surfaces cooperating with one another.

It is also favorable for a small building depth when the electromechanical transducer is disposed approximately in the same radial plane as the ring-shaped actuator and preferably parallel to a line which is tangent to the periphery of the actuator.

On the other hand, when the diameter should be minimized, it may be suitable to line up the ring-shaped driven member, the ring-shaped drive member and the ring-shaped actuator substantially co-linear axially succeed each other substantially collinearly in succession in axial direction, with their confronting end faces cooperating with each other.

To achieve a small diameter, it is also useful when the electromechanical transducer lies in a radial plane, which is offset in parallel to the radial plane in which the ring-shaped actuator is disposed.

The electromechanical transducer can, in particular, be an electric mini- or micro-motor, which may be configured in a manner known per se as a threaded spindle motor or is coupled downstream thereof with a corresponding transmission for converting the rotating movement into a translational movement of a spindle or a pin, which in turn acts on the locking member.

However, the electromechanical transducer preferably includes a bistable lifting magnet with an armature and an armature rod which acts on the locking member. The armature and thus the armature rod of such a lifting magnet are normally held in the one end position by a spring and in the other end position by a permanent magnet. For switching between the two end positions short current pulses of opposite signs are sufficient. In this case, the demand of electrical energy for switching the lock between the disengaged position and the engaged position (and vice versa) is extremely small.

The demand of electrical energy for the proposed lock can be satisfied by means of a battery. A configuration of the electromechanical transducer as bistable lifting magnet leads to a particularly long service life of the battery.

BRIEF DESCRIPTION OF THE DRAWING

The above and other objects, features and advantages of the present invention will be more readily apparent upon reading the following description of a preferred exemplified embodiment of the invention with reference to the accompanying drawing, in which:

FIG. 3 is a schematic illustration of the lock in disengaged state after generation of an electrical pulse;

FIG. 4 is a schematic illustration of the lock at the beginning of a new actuation of the drive slide;

FIG. 4*a* is a cutaway view of a detail of FIG. 4;

DETAILED DESCRIPTION OF PREFERRED EMBODIMENTS

Figure 1:
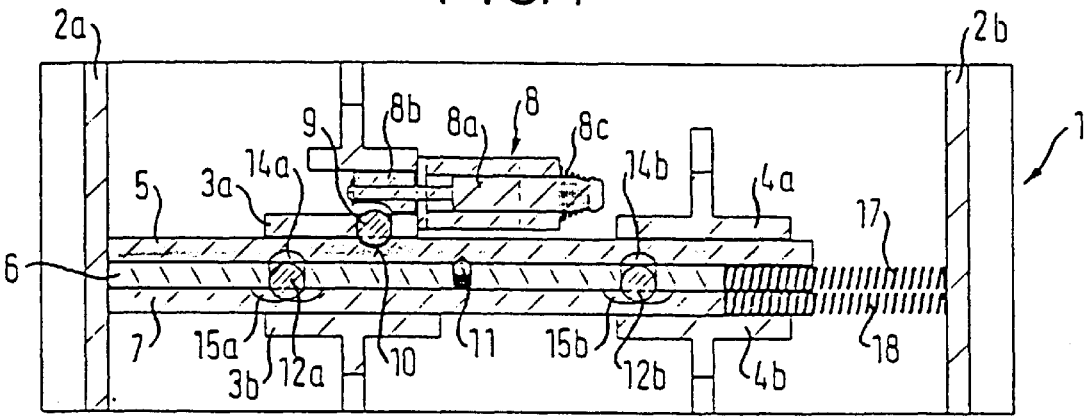
FIG. 1 is a schematic illustration of one embodiment of a lock with electromechanical coupling device in accordance with the present invention with linearly movable parts in disengaged rest position.

FIGS. 1 to 5 illustrate a principal configuration of a lock and its electromechanical coupling device in accordance with the present invention, with reference to various coupling conditions. It will be appreciated by persons skilled in the art that the lock must contain much mechanical apparatus which does not appear in the foregoing Figures, e.g. the manual operating means and the latch of the lock or the like. However, this apparatus, like much other necessary apparatus, is not part of the invention, and has been omitted from the Figures for the sake of simplicity.

In a housing 1, slideways 3*a*, 3*b* and 4*a*, 4*b* spaced from each other are disposed between side walls 2*a* and 2*b*. Between the slideways 3*a*, 3*b* and 4*a*, 4*b*, an actuator in the form of setting slide 5, a drive slide 6 and a driven slide 7 are provided. Above the slideway 3*a* a bistable lifting magnet 8 is disposed in a lying manner. Its armature 8*a* carries a clamping block 8*b* on its armature rod. The clamping block cooperates with a ball 9, which is movable in a bore of the upper slideway 3*a*.

FIG. 1 shows the disengaged rest position. In this position, a calotte-shaped recess 10 is provided in the setting slide 5 opposite the ball 9. The setting slide 5 is elastically latched with the drive slide 6 via a spring-loaded ball 11. In this embodiment, the ball 11 and the spring loading the same are disposed in the drive slide 6, and the setting slide 5 has a flat depression, groove or the like. The drive slide 6 has two cross holes, in each of which a ball 12*a* and 12*b*, respectively, is seated as locking body. Precisely opposite the balls 12*a* and 12*b*, the setting slide 5 has calotte-shaped recesses 14*a* and 14*b*, respectively. In the driven slide 7 opposite the balls 12*a*, 12*b*, depressions 15*a*, 15*b* are provided, whose depth is approximately equal to the depth of the calotte-shaped recesses 14*a*, 14*b*, but whose length is exceeds significantly the diameter of the balls 12*a*, 12*b*. The drive slide 6 and the driven slide 7 are each loaded by a helical compression spring 17 and 18, respectively, and are loaded into the rest position indicated in FIG. 1.

Figure 2:
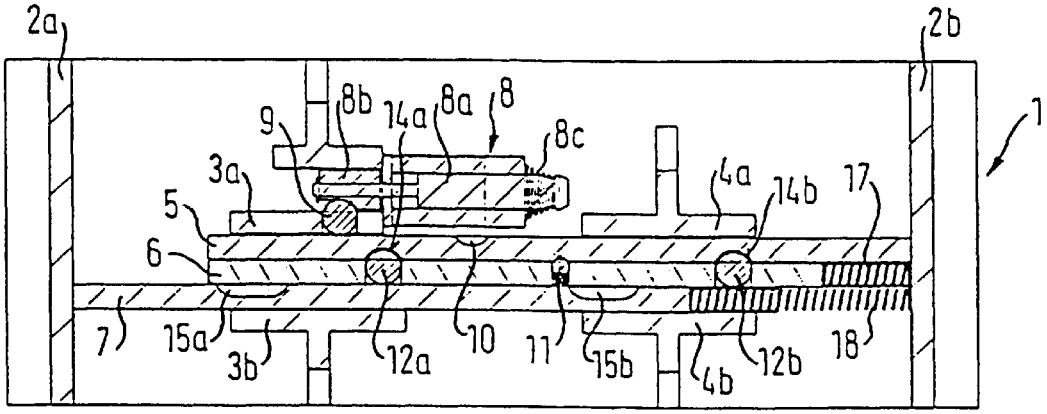
FIG. 2 is a schematic illustration of the lock in disengaged state.

FIG. 2 shows the disengaged condition upon actuation of the drive slide 6 in the sense of an attempt at opening the latch or locking bar of the lock. Due to its latching via the ball 11, the drive slide 6 has entrained the setting slide 5 into the illustrated position. The setting slide 5 has pushed the ball 9 from its depression 10 in the setting slide 5. The helical compression spring 17 is compressed. The driven slide 71 which is loaded by the helical compression spring 18, has not moved. The flat runout of its depressions 15*a*, 15*b* ensures that the balls 12*a*, 12*b* are lifted from the position indicated in FIG. 1. The necessary space is provided by the calotte-shaped recesses 14*a*, 14*b* in the setting slide 5 moved along with the driven slide 7.

FIG. 3 shows the same condition as FIG. 1, but after a short electrical pulse for producing the engaged condition. The pulse causes the armature 8*a* of the lifting magnet 8 to move into the left-hand end position, in which it also remains due to a permanent magnet (not shown) even when the pulse has subsided. The clamping block 8*b* now holds the ball 9 in the depression 10 of the setting slide 5, which is thereby blocked in this position.

FIG. 4 shows the condition at the beginning of a new actuation of the drive slide 6. Since the setting slide 5 is blocked, its latching with the drive slide 6 has been released by urging back the ball 11. The flat runouts of the depressions 15*a*, 15*b* in the driven slide 7 can no longer lift out the balls 12*a*, 12*b*, as the same are now offset with respect to the calotte-shaped recesses 14*a*, 14*b* in the setting slide 5. Rather, these balls 12*a*, 12*b* are now blocked in the entrainment position represented in FIG. 4*a* on an enlarged scale and thus frictionally connect the drive slide 6 with the driven slide 7.

Figure 5:
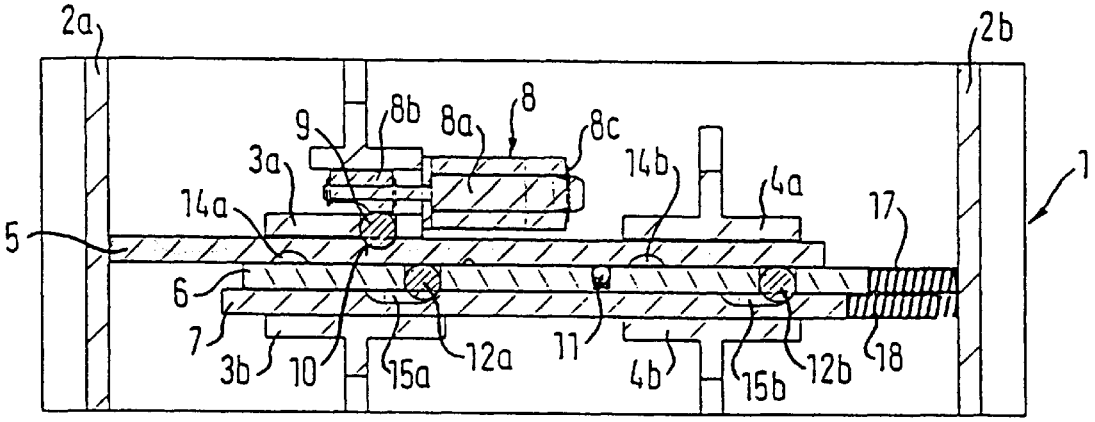
FIG. 5 is a schematic illustration of the lock in an end position.

In the case of a further movement of the drive slide 6, the latter therefore entrains the driven slide 7 into the end position represented in FIG. 5, in which end position a latch (not shown) connected with the driven slide 7 is in the retracted position.

Upon relieving the drive slide 6, the compressed compression springs 17 and 18 provide for the return of the drive slide 6 and the driven slide 7 into the position shown in FIG. 1. By means of another electrical pulse of inverse sign, the armature 8*a* of the lifting magnet 8 can be moved into the right-hand end position, in which it is held by a conical spring 8*c*, even after the pulse has disappeared.

Figure 6:
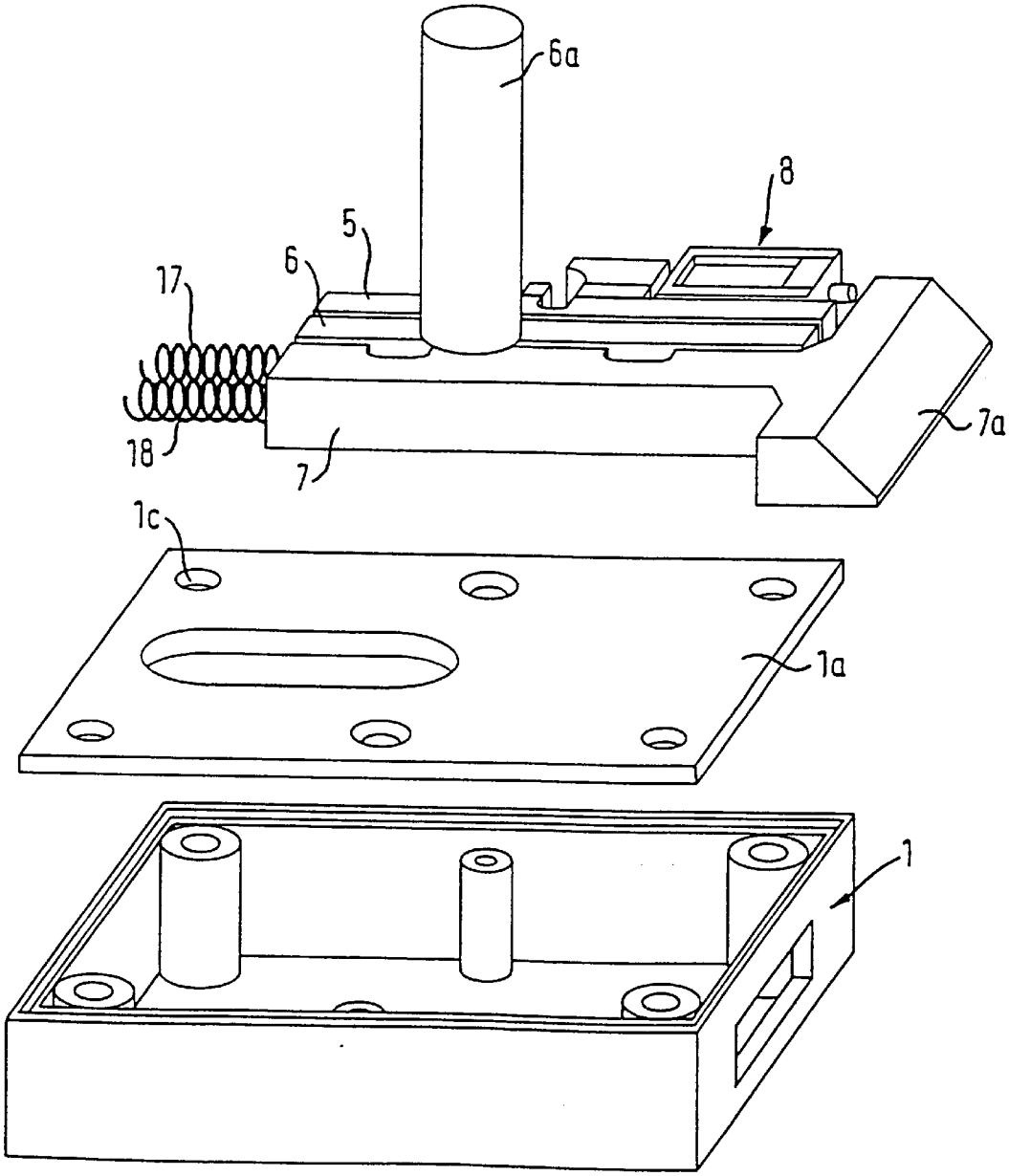
FIG. 6 is a perspective view, in exploded illustration, of a practical implementation of a lock according to the present invention.
Figure 7:
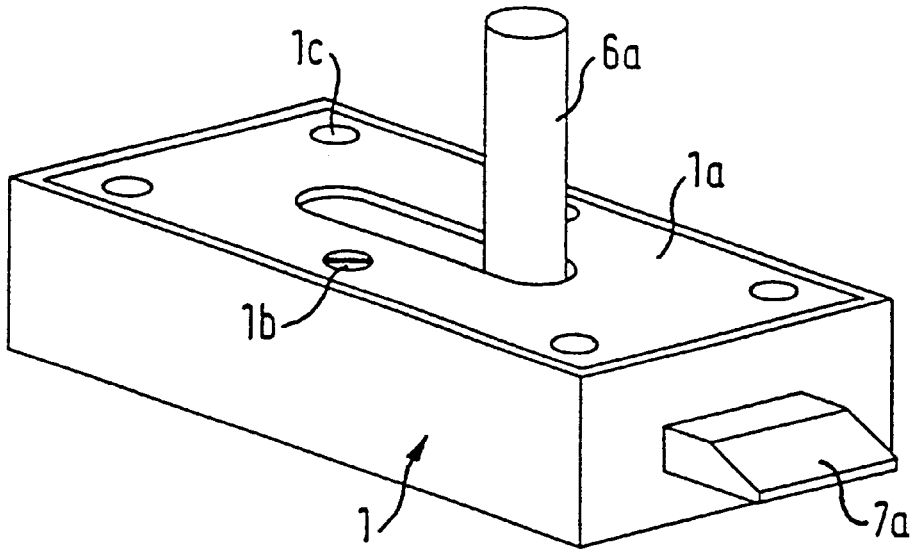
FIG. 7 is a perspective illustration of the lock of FIG. 6 in assembled condition.
Figure 8:
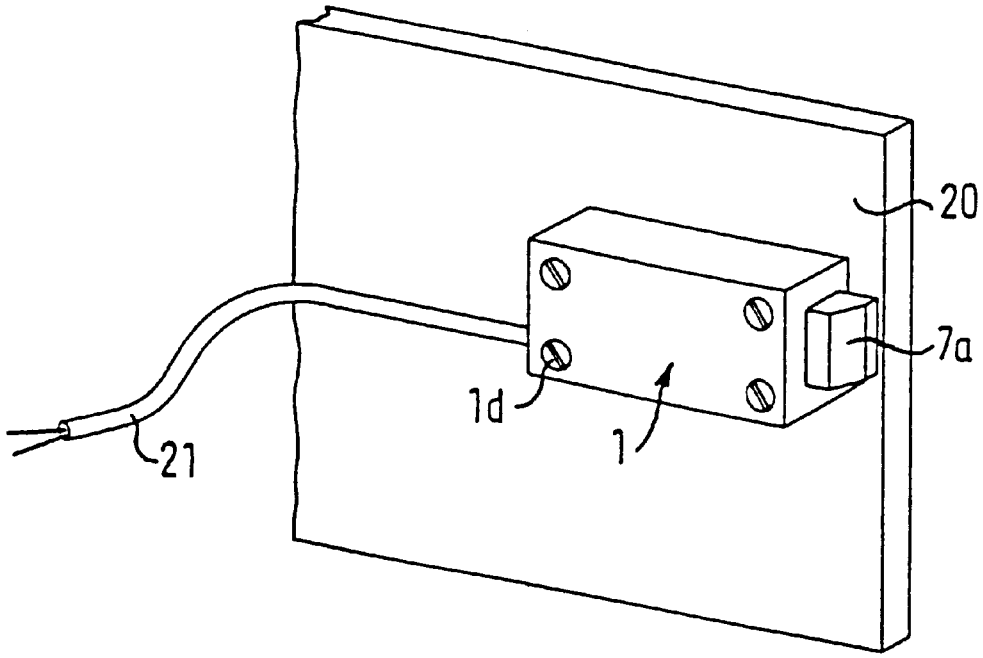
FIG. 8 is a perspective view of the lock of FIG. 6 mounted to an exemplified door.

FIGS. 6 to 8 show a simple box lock designed according to this constructional principle, comprising a sliding bolt 6*a* which acts on the drive slide 6 and a latch 7*a* which is integral with the driven slide 7. The housing 1 has a lid 1*a* which is fastened via screws 1*b*. The housing 1 has bores 1*c* for screws 1*d* for fastening the lock to an exemplified door 20. The lifting magnet 8 in the lock can be activated via a connecting cable 21.

FIGS. 9 to 14 illustrate a second, preferred embodiment of the lock, in which the movable parts constitute rotatable rings, and which is above all suited for mortise locks, whose latch and/or locking bar is actuated via a door handle (or an outer and an inner pawl).

Figures 9, 10:
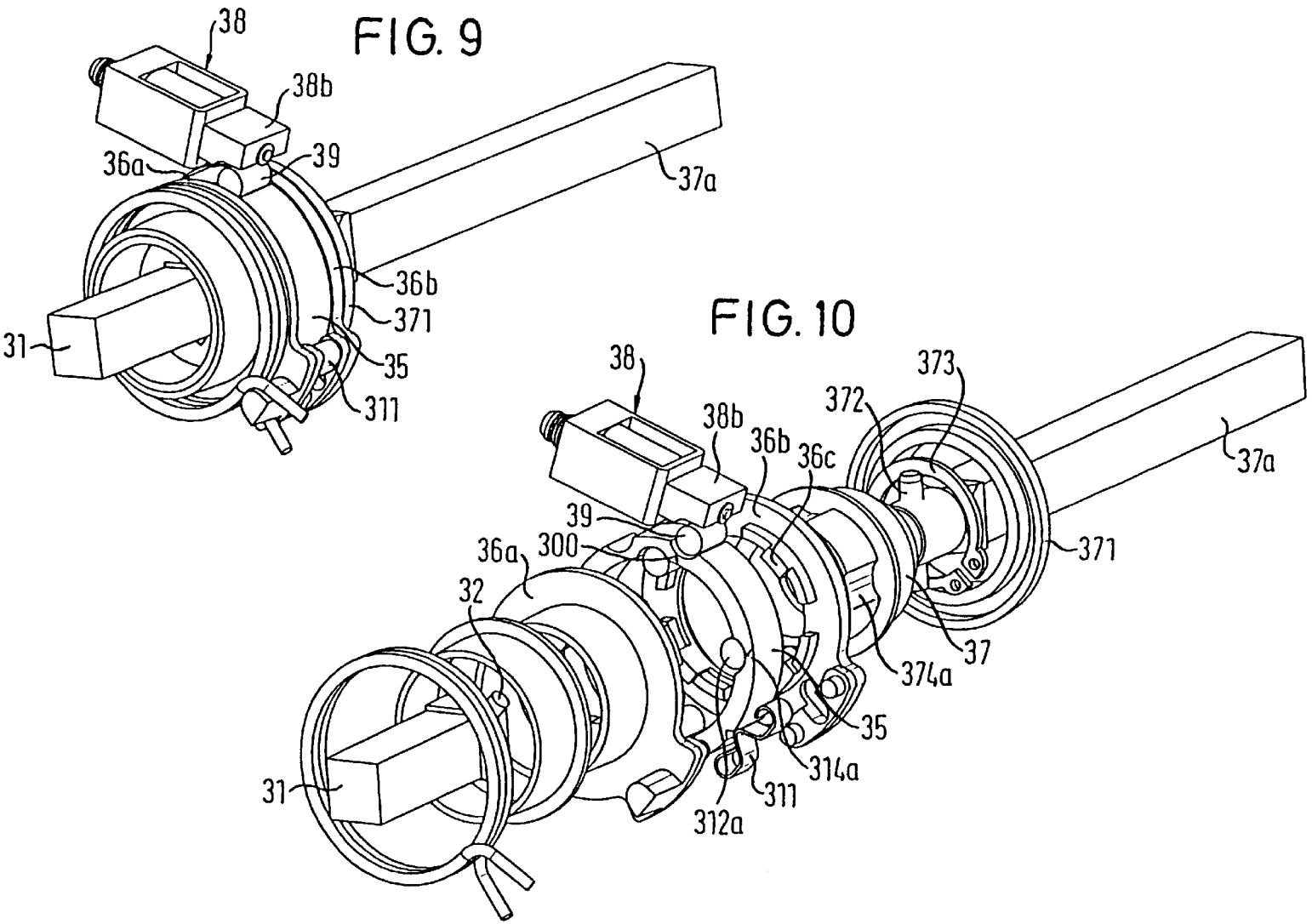
FIG. 9 is a perspective illustration of a second embodiment of a lock according to the present invention with rotatably mounted parts.
FIG. 10 is an exploded view of the lock of FIG. 9.
Figure 12:
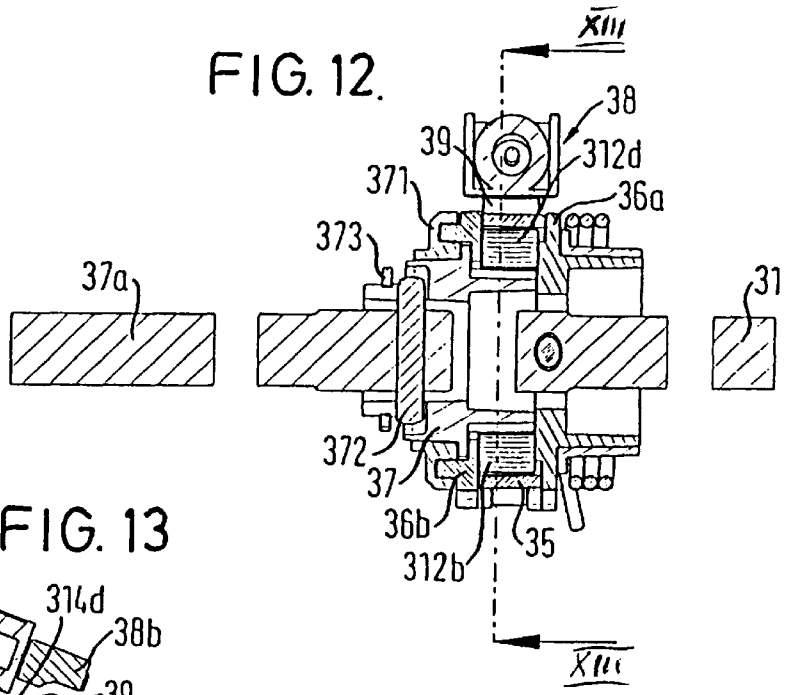
FIG. 12 is a sectional view of the lock, taken along the line XII—XII in FIG. 11.
Figure 13:
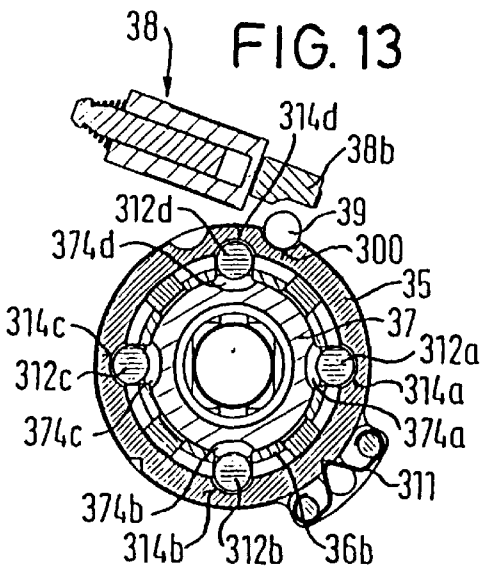
FIG. 13 is a sectional view of the lock, taken along the line XIII—XIII in FIG. 12.
Figure 11:
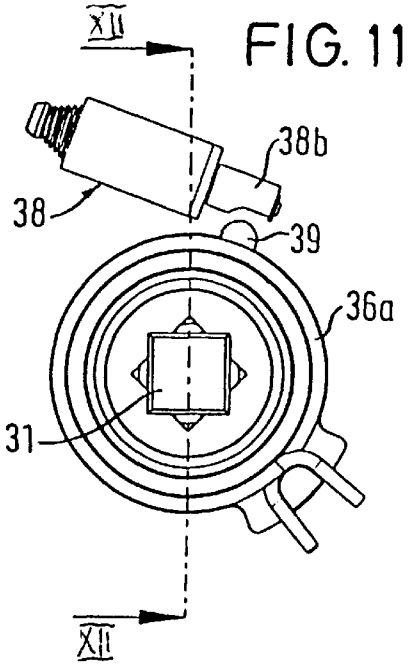
FIG. 11 is a top view of the drive side of the lock of FIG. 9.

FIG. 9 primarily shows the compact design of the lock.

FIGS. 10 to 14 illustrate the structure in detail. The outer door handle (not shown) urges on an outer square 31, which is positively connected with an outer ring 36*a*, which together with an inner ring 36*b* forms the ring-shaped drive member. Disposed between the outer ring 36*a* and the inner ring 36*b* is an actuator in the form of a setting ring 35. The setting ring 35 is elastically latched with the drive rings 36*a*, 36*b* via a curved leaf spring 311, which is fixed on the inner ring 36*b*, and to effect such latching has a flat, axially parallel groove in its peripheral surface.

Approximately tangential to the setting ring 35, a bistable lifting magnet 38 is disposed, whose clamping block 38*b* acts on a roller 39 as locking body. The same lies in a depression 300 from the outer periphery of the setting ring 35. The setting ring 35 is mounted on ring segments 36*c* formed at the outer ring 36*a* and the inner ring 36*b*. Between the ring segments 36*c*, there are provided four recesses offset from each other by 90° for receiving four rollers 312*a* to 312*d* as locking members, which are movable between depressions 314*a* to 314*d* in the setting ring 35 and comparatively broader depressions 374*a* to 374*d* in a driven ring 37. The ring-shaped driven member 37 is in turn mounted in the inner ring 36*b* and a plastic sleeve 371. Connected with the ring-shaped driven member 37 is a driven square 37*a* which engages in the nut (not shown) of a common box-type mortise lock. Transverse pin 372 and retaining ring 373 are used to connect the ring-shaped driven member 37 with the driven square 37. The function of this embodiment corresponds to that of the translational embodiment as shown in FIGS. 1 to 5.

Figure 14:
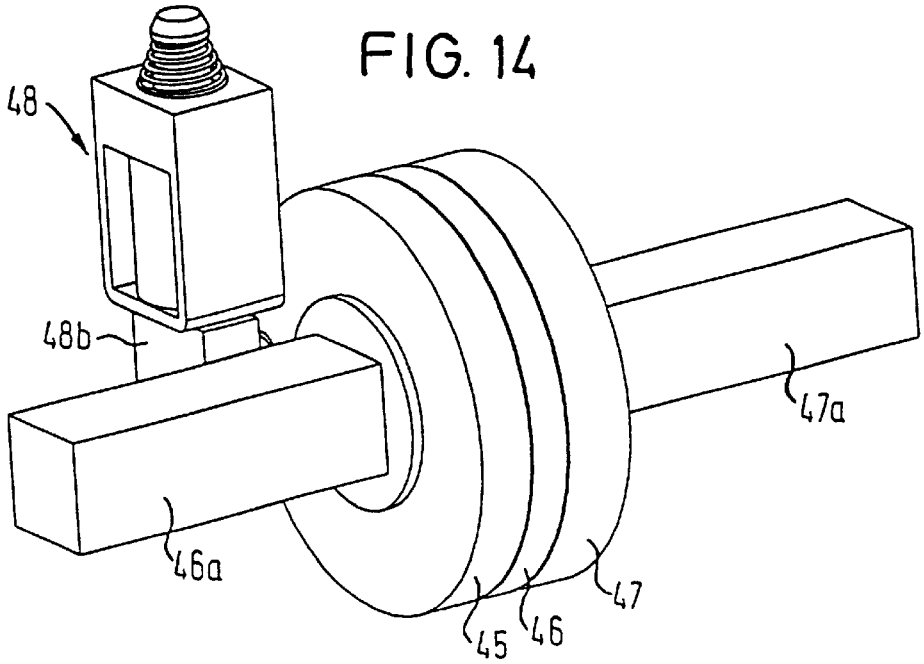
FIG. 14 is a perspective illustration of a third embodiment of a lock according to the present invention with rotatably mounted parts.
Figure 15:
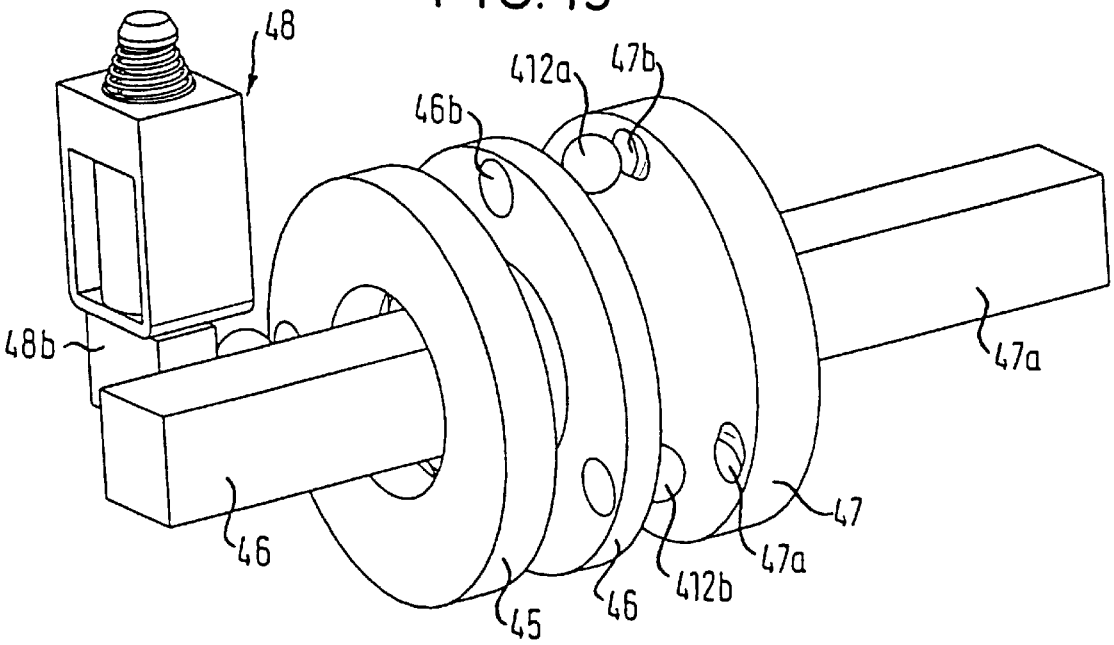
FIG. 15 is a simplified exploded view of the lock of FIG. 14.

FIGS. 14 and 15 show simplified illustrations of a third embodiment which largely corresponds to the embodiment as shown in FIGS. 9 to 13, except for a configuration with reduced diameter to realize a greater structural depth. While in the second embodiment the locking body in the form of the rollers 39 and 317 is radially movable and the lifting magnet 38 is disposed radially outside the setting ring 35, the locking bodies or locking members in accordance with the third embodiment are axially movable steel balls and the lifting magnet is mounted axially offset with respect to the rings. FIGS. 14 and 15 merely illustrate the successive disposition of the parts, namely the drive square 46*a* which acts on the ring-shaped drive member 46, the setting ring 45 with the associated lifting magnet 48 with the clamping block 48*b* as well as the ring-shaped driven member 47 with the driven square 47*a* and the steel balls 412*a*, 412*b*, which are axially movable in axial bores 46*b* of the ring-shaped drive member 46 between an idling position and a locking position, in which they engages in depressions 47*a*, 47*b* in the ring-shaped driven member 47.

While the invention has been illustrated and described as embodied in a lock with an electromechanical coupling device, it is not intended to be limited to the details shown since various modifications and structural changes may be made without departing in any way from the spirit of the present invention.

What is claimed as new and desired to be protected by Letters Patent is set forth in the appended claims:

1. A lock, in particular a door lock, comprising an electromechanical coupling device which effects an operative connection with a driven member, when an authentication code is recognized, with the driven member in constant operative connection with an operating mechanism, said drive member and said driven member of the coupling device each being spring-loaded into a rest position and configured for coupling via a locking mechanism which is switchable by an electromechanical transducer between a disengaged position and an engaged position, said locking mechanism comprising an actuator releasably latched with the drive member and moveable in a same direction as the drive member, when the locking mechanism is in the disengaged position, and blocked in its rest position by the electromechanical transducer in the engaged position, with the latching action being automatically released upon movement of the drive member, and at least one locking member which is movable into and out of engagement with the drive member approximately at a right angle to a plane of movement of the drive member, said actuator having a recess disposed opposite the locking member in the rest position, and said driven member having a recess which is disposed opposite the locking member, wherein in the disengaged position, the driven member in its rest position urges the locking member into the recess of the actuator entrained by the drive member upon movement of the drive member, and in the engaged position, the actuator blocked in its rest position urges the locking member into the recess of the driven member and thereby entrains the driven member, upon movement of the drive member.

2. A lock, in particular a door lock, comprising an electromechanical coupling device which effects an operative connection with a driven member, when an authentication code is recognized, with the driven member in constant operative connection with an operating mechanism, said drive member and said driven member of the coupling device each being spring-loaded into a rest position and configured for coupling via a locking mechanism which is switchable by an electromechanical transducer between a disengaged position and an engaged position, said locking mechanism comprising an actuator releasably latched with the drive member and moveable in a same direction as the drive member, when the locking mechanism is in the disengaged position, and blocked in its rest position by the electromechanical transducer in the engaged position, with the latching action being automatically released upon movement of the drive member, and at least one locking member which is movable into and out of engagement with the drive member approximately at a right angle to a plane of movement of the drive member, said actuator having a recess disposed opposite the locking member in the rest position, and said driven member having a recess which is disposed opposite the locking member, wherein in the disengaged position, the driven member in its rest position urges the locking member into the recess of the actuator entrained by the drive member upon movement of the drive member, and in the engaged position, the actuator blocked in its rest position urges the locking member into the recess of the driven member and thereby entrains the driven member, upon movement of the drive member, and wherein in the disengaged position, the driven member in its rest position urges the locking member into the recess of the actuator entrained by the drive member upon movement of the drive member, and in the engaged position, the actuator blocked in its rest position urges the locking member into the recess of the driven member and thereby entrains the driven member, upon movement of the drive member, wherein the releasable latching between the actuator and the drive member includes an engagement part connected with one of the actuator and drive member and engaging in the recess of the other one of actuator and drive member under an elastic bias.

3. The lock of claim 2, wherein in the engaged position the electromechanical transducer moves a locking member into a positive engagement with the actuator for blocking the actuator in the rest position.

4. The lock of claim 3, wherein in the disengaged position the actuator urges the locking member into a release position, when the actuator is entrained by the drive member.

5. The lock of claim 3, wherein at least one of the locking body and the locking member is an element selected from the group consisting of a roller and a ball.

6. The lock of claim 2, wherein the electromechanical transducer is a bistable lifting magnet.

7. The lock of claim 2, wherein the electromechanical transducer lies in a plane parallel to the plane of movement of the actuator.

8. The lock of claim 2, wherein the actuator, the drive member and the driven member are rotatably mounted.

9. The lock of claim 8, wherein the actuator, the drive member and the driven member constitute rings with a common axis of rotation.

10. The lock of claim 9, wherein the ring-shaped drive member is positively connected with a first square for mounting the operating handle, said ring-shaped driven member being frictionally connected with a second square for actuating the nut of a common door lock.

11. The lock of claim 9, wherein the ring-shaped driven member, the ring-shaped drive member and the ring-shaped actuator are disposed in substantially concentric relation to each other, with their confronting peripheral surfaces cooperating with each other.

12. The lock of claim 8, wherein the electromechanical transducer is disposed approximately in a same radial plane as the actuator.

13. The lock of claim 2, wherein the electromechanical transducer is disposed in parallel relation to a line which is tangent to the periphery of the actuator.

14. The lock of claim 9, wherein the ring-shaped driven member, the ring-shaped drive member and the ring-shaped actuator are disposed substantially co-linear in succession in axial direction, with their confronting end faces cooperating with each other.

15. The lock of claim 13, wherein the electromechanical transducer lies in a radial plane which is offset in parallel to the radial plane in which the actuator is disposed.

16. A lock, in particular a door lock, comprising an electromechanical coupling device which effects an operative connection with a driven member, when an authentication code is recognized, with the driven member in constant operative connection with an operating mechanism, said drive member and said driven member of the coupling device each being spring-loaded into a rest position and configured for coupling via a locking mechanism which is switchable by an electromechanical transducer between a disengaged position and an engaged position, said locking mechanism comprising an actuator releasably latched with the drive member and moveable in a same direction as the drive member, when the locking mechanism is in the disengaged position, and blocked in its rest position by the electromechanical transducer in the engaged position, with the latching action being automatically released upon movement of the drive member, and at least one locking member which is movable into and out of engagement with the drive member approximately at a right angle to a plane of movement of the drive member, said actuator having a recess disposed opposite the locking member in the rest position, and said driven member having a recess which is disposed opposite the locking member, wherein in the disengaged position, the driven member in its rest position urges the locking member into the recess of the actuator entrained by the drive member upon movement of the drive member, and in the engaged position, the actuator blocked in its rest position urges the locking member into the recess of the driven member and thereby entrains the driven member, upon movement of the drive member, wherein in the engaged position the electromechanical transducer moves the blocking member into a positive engagement with the actuator for blocking the actuator in the rest position and wherein in the disengaged position the actuator urges the locking member into a release position, when the actuator is entrained by the drive member.

17. A lock, in particular a door lock, comprising an electromechanical coupling device which effects an operative connection with a driven member, when an authentication code is recognized, with the driven member in constant operative connection with an operating mechanism, said drive member and said driven member of the coupling device each being spring-loaded into a rest position and configured for coupling via a locking mechanism which is switchable by an electromechanical transducer between a disengaged position and an engaged position, said locking mechanism comprising an actuator releasably latched with the drive member and moveable in a same direction as the drive member, when the locking mechanism is in the disengaged position, and blocked in its rest position by the electromechanical transducer in the engaged position, with the latching action being automatically released upon movement of the drive member, and at least one locking member which is movable into and out of engagement with the drive member approximately at a right angle to a plane of movement of the drive member, said actuator having a recess disposed opposite the locking member in the rest position, and said driven member having a recess which is disposed opposite the locking member, wherein in the disengaged position, the driven member in its rest position urges the locking member into the recess of the actuator entrained by the drive member upon movement of the drive member, and in the engaged position, the actuator blocked in its rest position urges the locking member into the recess of the driven member and thereby entrains the driven member, upon movement of the drive member, and wherein in the engaged position the electromechanical transducer moves a locking member into a positive engagement with the actuator for blocking the actuator in the rest position, and wherein the locking member is an element selected from the group consisting of a roller and a ball.

* * * * *